US012338649B2

(12) United States Patent
Dunning-Gill

(10) Patent No.: US 12,338,649 B2
(45) Date of Patent: Jun. 24, 2025

(54) FENCE CUSHION

(71) Applicant: Dianne Dunning-Gill, Kirkwood, MO (US)

(72) Inventor: Dianne Dunning-Gill, Kirkwood, MO (US)

( * ) Notice: Subject to any disclaimer, the term of this patent is extended or adjusted under 35 U.S.C. 154(b) by 464 days.

(21) Appl. No.: 17/745,444

(22) Filed: May 16, 2022

(65) Prior Publication Data

US 2022/0282519 A1 Sep. 8, 2022

Related U.S. Application Data

(63) Continuation-in-part of application No. 29/716,117, filed on Dec. 6, 2019, now Pat. No. Des. 952,193.

(51) Int. Cl.
*E04H 17/00* (2006.01)
*A47C 16/00* (2006.01)

(52) U.S. Cl.
CPC ..... *E04H 17/006* (2021.01); *A47C 16/00* (2013.01)

(58) Field of Classification Search
CPC ..... E04H 17/003; E04H 17/006; E04H 17/02; E04H 17/06; E04H 17/066; E04H 17/143; A47C 16/00
USPC ..... 256/11
See application file for complete search history.

(56) References Cited

U.S. PATENT DOCUMENTS

| | | | | | |
|---|---|---|---|---|---|
| 3,523,710 | A * | 8/1970 | Barecki | B60N 2/7035 | 297/445.1 |
| 4,523,745 | A * | 6/1985 | Killman | E04H 17/00 | 5/663 |
| D369,391 | S * | 4/1996 | Jump, Jr. | D21/685 | |
| D444,243 | S * | 6/2001 | Erwin | E04H 17/16 | D25/135 |
| 7,086,641 | B2 * | 8/2006 | Petrozziello | E04H 17/05 | 256/32 |
| 7,118,096 | B2 * | 10/2006 | Petrozziello | E04H 17/066 | 256/33 |
| D705,452 | S * | 5/2014 | Yakos | D25/135 | |
| D741,962 | S * | 10/2015 | Terrian | D21/686 | |
| 10,687,616 | B2 * | 6/2020 | Brennan | A47B 13/003 | |
| 2004/0012007 | A1 * | 1/2004 | Cummings | E04H 17/1447 | 256/65.1 |
| 2009/0032788 | A1 * | 2/2009 | Adler | E04H 17/017 | 256/11 |
| 2015/0048290 | A1 * | 2/2015 | Volin | E04H 17/161 | 256/24 |
| 2022/0259886 | A1 * | 8/2022 | Chase | E04H 17/1602 | |

FOREIGN PATENT DOCUMENTS

| | | | | |
|---|---|---|---|---|
| DE | 29518821 U1 * | 3/1996 | | |
| WO | WO-9306323 A1 * | 4/1993 | | E01F 13/022 |

* cited by examiner

*Primary Examiner* — Jonathan P Masinick
(74) *Attorney, Agent, or Firm* — Hovey Williams LLP

(57) ABSTRACT

A cushion for removably coupling to a fence.

17 Claims, 10 Drawing Sheets

FENCE CUSHION

CROSS REFERENCE TO RELATED APPLICATION

This application is a continuation-in-part of U.S. Design patent application Ser. No. 29/716,117, filed Dec. 6, 2019, entitled CUSHION FOR FENCE, which is hereby incorporated in its entirety by reference herein.

BACKGROUND

The embodiments described herein relate generally to cushions, and more particularly, to methods and systems for coupling a cushion to a fence for a user to rest upon the cushion while observing an event.

Events such as sporting events or other spectator events often have a fence surrounding a field that is associated with the event. Typically, the fence surrounds or partially encloses the field to define the field boundaries and to separate the field from spectators. Conventional fences include a chain link configuration having fence tips, barbs, pickets, and/or balusters that extend from a chain link mesh and beyond a top rail of the fence. Spectators often lean or rest their hands, forearms, and/or elbows on the fence tips to view the event.

Leaning or resting on the fence tips, however, can lead to loosening, weakening, and/or damaging the fence. Moreover, leaning or resting on the fence tips can lead to discomfort or pain for the spectator who is leaning on the fence while watching the event. As a result, there is a need for a cushion that can easily, efficiently, and conveniently removably couple to a fence to protect the fence from damage. Additionally, there is a need for a cushion that can removably couple to a fence to provide padding and comfort to the user who is leaning on the fence.

SUMMARY

According to one aspect of the present disclosure, a cushion for a fence is provided. The cushion includes a member having a first end, a second end, and a body extending therebetween along a longitudinal axis between the first end and the second end. The cushion further includes a fence portion coupled to the member. The fence portion includes a first portion end, a second portion end, and a channel extending between the first portion end and the second portion end, wherein the channel is configured to reciprocate between a first position and a second position such that in the second position the channel is configured to removably couple to the fence.

This summary is provided to introduce a selection of concepts in a simplified form. These concepts are further described below in the detailed description of the preferred embodiments. This summary is not intended to identify key features or essential features of the claimed subject matter, nor is it intended to be used to limit the scope of the claimed subject matter.

Various other aspects and advantages of the present disclosure will be apparent from the following detailed description of the preferred embodiments and the accompanying drawing figures.

DRAWINGS

These and other features, aspects, and advantages will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

The present disclosure is susceptible of embodiment in many different forms. While the drawings illustrate, and the specification describes, certain preferred embodiments of the disclosure, it is to be understood that such disclosure is by way of example only. There is no intent to limit the principles of the present disclosure to the embodiments.

Furthermore, unless specified or made clear, the directional references made herein with regard to the present disclosure and/or associated components (e.g., top, bottom, upper, lower, front, rear, side, inner, and outer, for example) are used solely for the sake of convenience and should be understood only in relation to each other. For instance, a component might in practice be oriented such that faces referred to as "top" and "bottom" are sideways, angled, inverted, relative to the chosen frame of reference.

As will be apparent from the structural description, the cushion provides numerous advantages. For example, the cushion of the present embodiments provides for a cushion that can easily, efficiently, and conveniently removably couple to a fence to protect the fence from damage. Additionally, the cushion of the present embodiments provides that can easily removably couple to a fence to provide padding and comfort to the user who is leaning on the fence. Moreover, the cushion is lightweight and can facilitate coupling to a variety of fence types. The present cushion can also provide an accessory holder to hold a user's accessory such as a mobile phone. Indentions on the cushion facilitate convenient locations for the user to rest body parts such as forearms on the cushion while the cushion is placed on the fence. The cushion is economical to manufacture and can use a variety of materials.

Generally, a cushion of the present disclosure is made from one or more materials that are configured to protect a fence and to provide padding to the user. The materials can include, but are not limited to, plastics, foams, woven fabric, nonwoven fabric, and films. The cushion may be removably coupled at any suitable location with respect to the fence. Alternatively, the cushion can be permanently coupled at any suitable location to and with respect to the fence.

Figure 1:
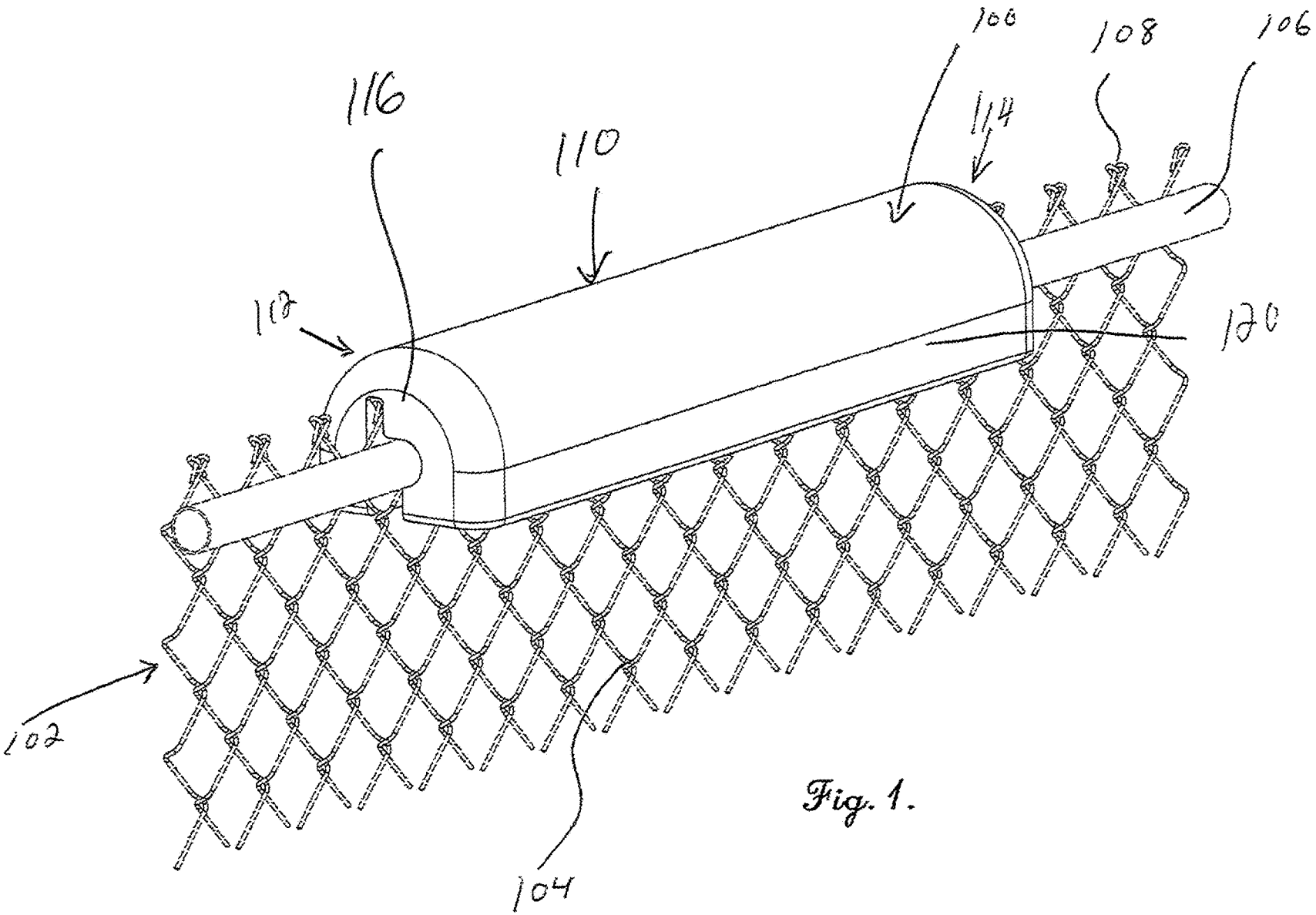
FIG. 1 is a front perspective of an exemplary cushion of the present disclosure removably coupled to a fence.
Figure 2:
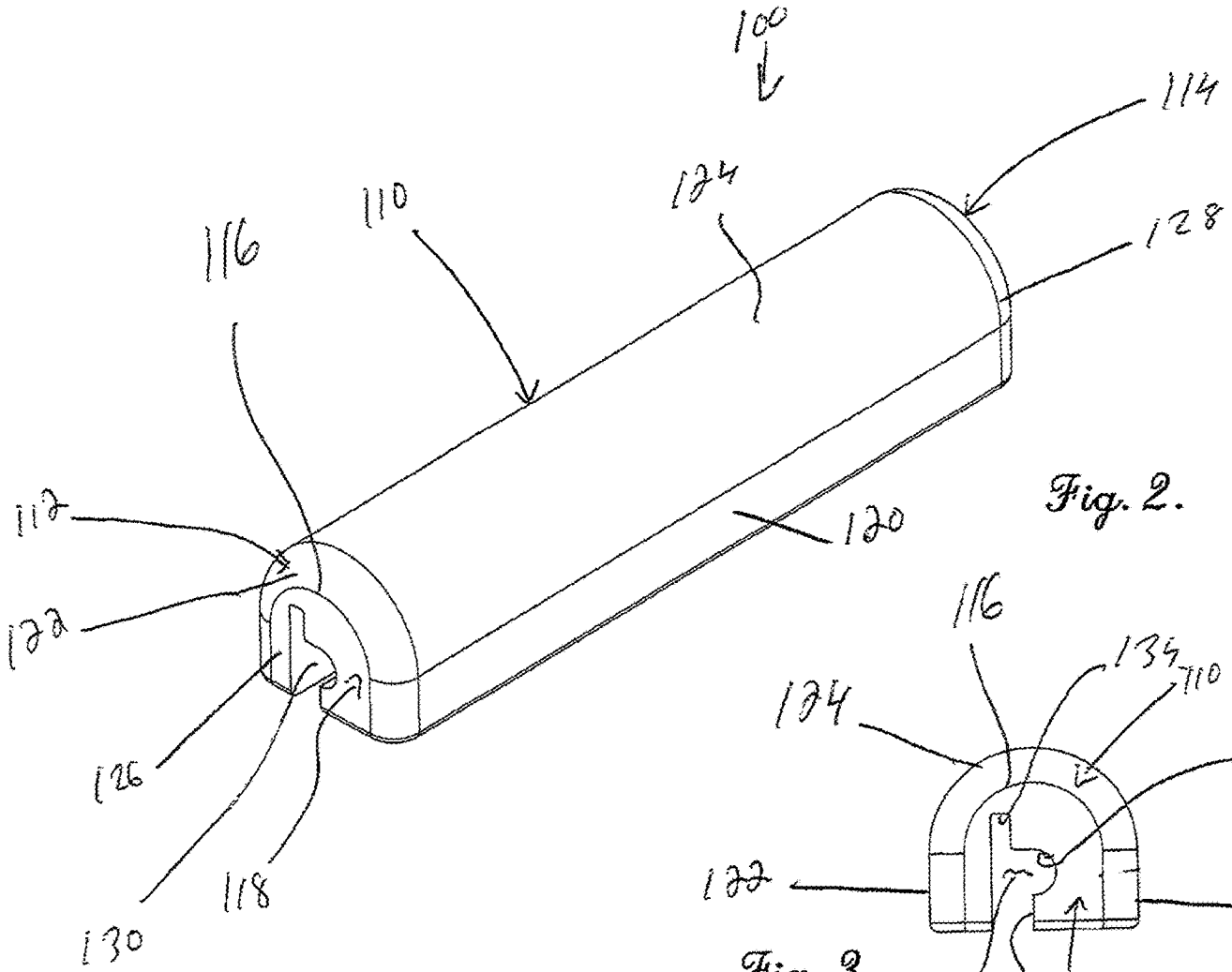
FIG. 2 is a front perspective view of the exemplary cushion of FIG. 1 having a member with a first end, a second end, and a body extending between the first end and the second and having a fence portion coupled to the member.

FIG. 1 is a front perspective view of an exemplary cushion 100 removably coupled to a fence. FIG. 2 is a front perspective view of the cushion 100. The illustrative fence 102 is a chain link fence having a chain link mesh 104, a top rail 106, and a plurality of fence tips 108. The chain link mesh 104 and/or fence tips 108 are typically coupled to the top rail 106. The fence tips 108 extend from the chain link mesh 104 and beyond and above the top rail 106. The fence tips 108 can include a variety of configurations such as, but not limited to, barbed tips, pickets, and balusters. Moreover, the fence 102 can include other components (not shown) such as mounting posts and gates. Additionally, the fence can include a variety of fence types, for example, picket fences and dog-eared fences.

The cushion 100 includes a member 110 having a first end 112, a second end 114, and a body 116 extending therebetween the first end 112 and the second end 114. The cushion 100 further includes a fence portion 118 coupled to the member 110. In the exemplary embodiment, the fence portion 118 is integrally coupled to the member 110 as a one, continuous piece configuration. Alternatively, the fence portion 118 can be removably coupled to the member 110. The fence portion 118 can be removably coupled to the member 110 via fasteners (not shown) such as, for example only, an adhesive, a hook, a peg, and a hook and loop fastener. In the exemplary embodiment, the removable fence portion 118 is configured to be interchangeable with the member 110 to accommodate different configurations, and sizes of fence tips 108 and/or top rails 106.

The body 116 includes a first side 120, a second side 122, and a surface 124 extending therebetween the first side 120 and the second side 122. In the illustrative embodiment, the first side 120 and the second side 122 are parallel or substantially parallel to each other. The surface 24 curvilinearly extends between the first side 120 and the second side 122. Alternatively, the surface 24 can extend in a non-curvilinear configuration between the first side 120 and the second side 122.

Figure 3:
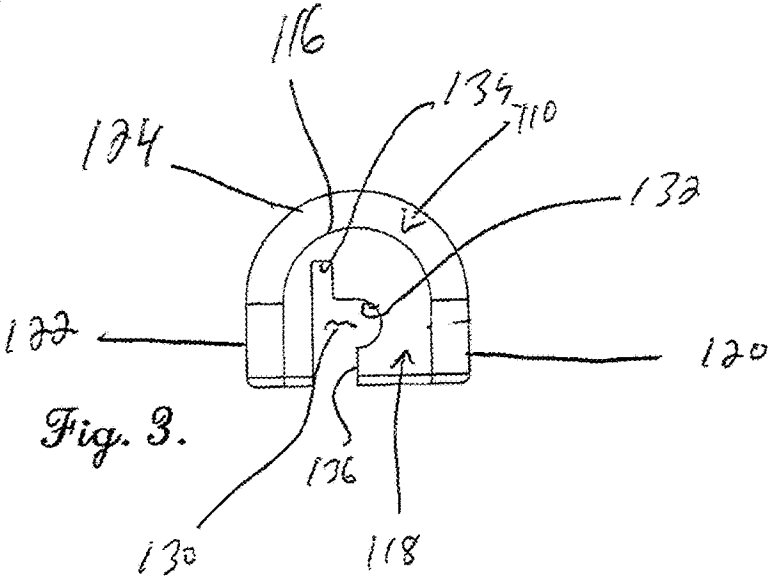
FIG. 3 is an end elevational view of the cushion of FIG. 2.

The fence portion 118 includes a first portion end 126 and second portion end 128 and a channel 130 extending between the first portion end 126 and the second portion end 128. Referring to FIGS. 2 and 3, the channel 130 includes a first channel portion 132, a second channel portion 134, and a third channel portion 136. The first channel portion 132 extends into the fence portion 118 and towards the first side 120 of the member 110. The second channel portion 134 extends from the first channel portion 132, into the fence portion 118 and toward the surface 124 of the member 110. The third channel portion 136 extends from the first channel portion 132 and opposite and away from the second channel portion 134.

In the exemplary embodiment, the first channel portion 132, the second channel portion 134, and the third channel portion 136 have different sizes and shapes. More particularly, the first channel portion 132 has a curvilinear shape, the second channel portion 134 has a rectangular shape, and the third channel portion 136 has a square shape. The sizes and shapes of the first channel portion 132, the second channel portion 134, and the third channel portion 136 are configured to efficiently, and conveniently to presserably removably couple to components of the fence 102.

More particularly, the first channel portion 132 is sized and shaped to receive, accommodate, fit, surround and/or partially surround the top rail 106. The second channel portion 134 is sized and shaped to receive, accommodate, fit, surround and/or partially surround at least one of the fence tips 108. The third channel portion 136 is sized and shaped to accommodate, receive, fit, surround and/or partially surround portion of the chain link mesh 104 and/or top rail 106. Alternatively, the first channel portion 132, the second channel portion 134, and the third channel portion 136 can have similar sizes and shapes.

The first channel portion 132, the second channel portion 134, and the third channel portion 136 are configured to facilitate the cushion 100 being flexible or bendable such that the first side 120 and the second side 122 can reciprocately move away and toward each other through the flexing or bending of the body 116 relative to the first channel, 132, the second channel 134, and/or the third channel 136. More particularly, in a first position, the first side 120 and the second side 122 move, flex or bend away from each other. In a second position, the first side 120 and the second side 122 move, flex or bend toward each other.

Figure 4:
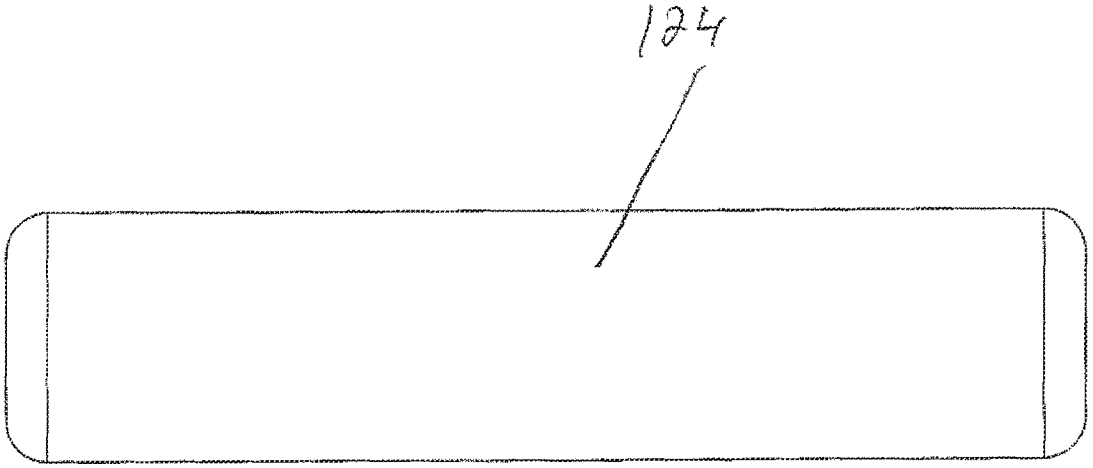
FIG. 4 is a top view of the cushion of FIG. 2.
Figure 5:
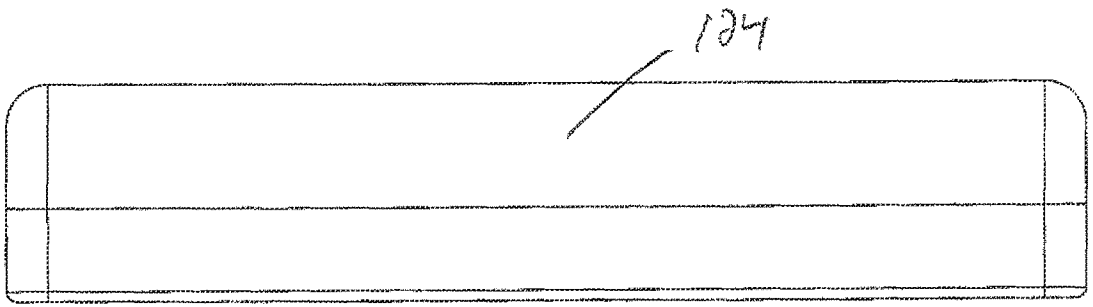
FIG. 5 is a side elevational view of the cushion of FIG. 2.
Figure 6:
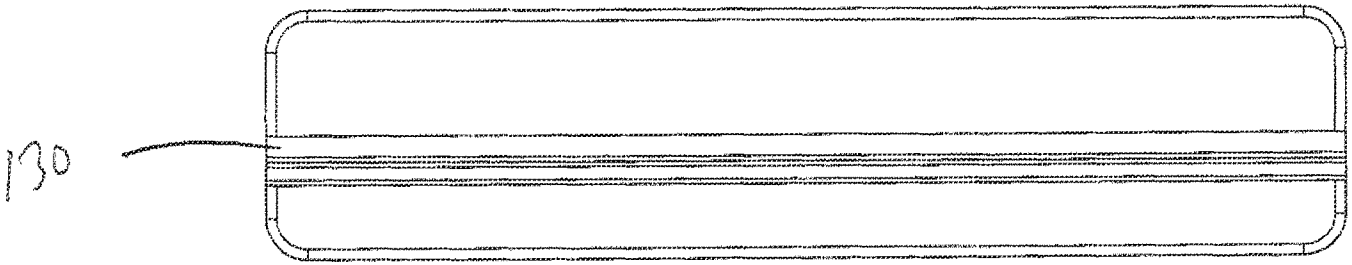
FIG. 6 is a bottom view of the cushion of FIG. 2.
Figures 7, 8:
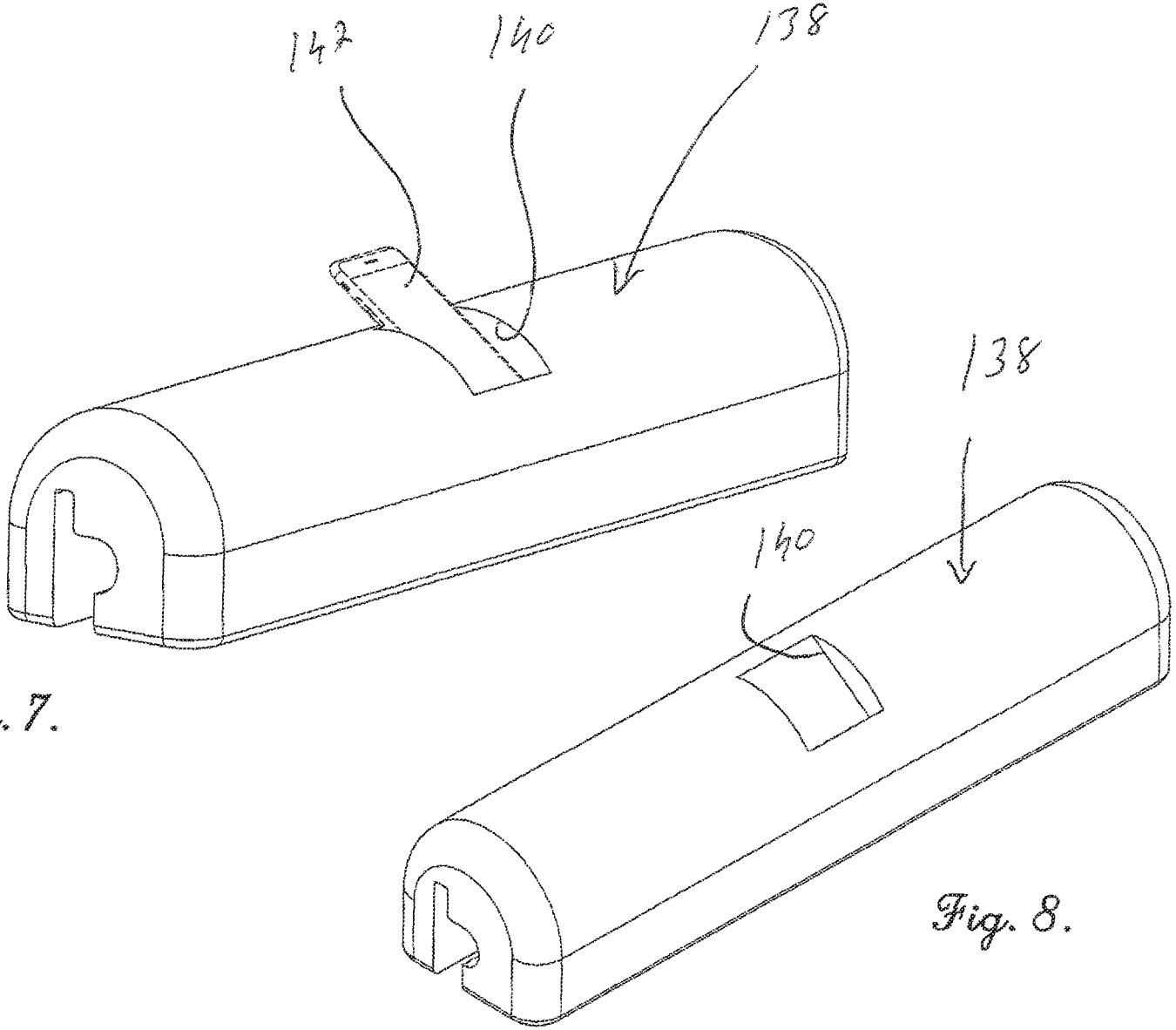
FIG. 7 is a front perspective view of another exemplary cushion of the present disclosure and having an accessory holder configured to hold an accessory.
FIG. 8 is a front perspective view of the cushion of FIG. 7 illustrating the accessory holder.
Figure 9:
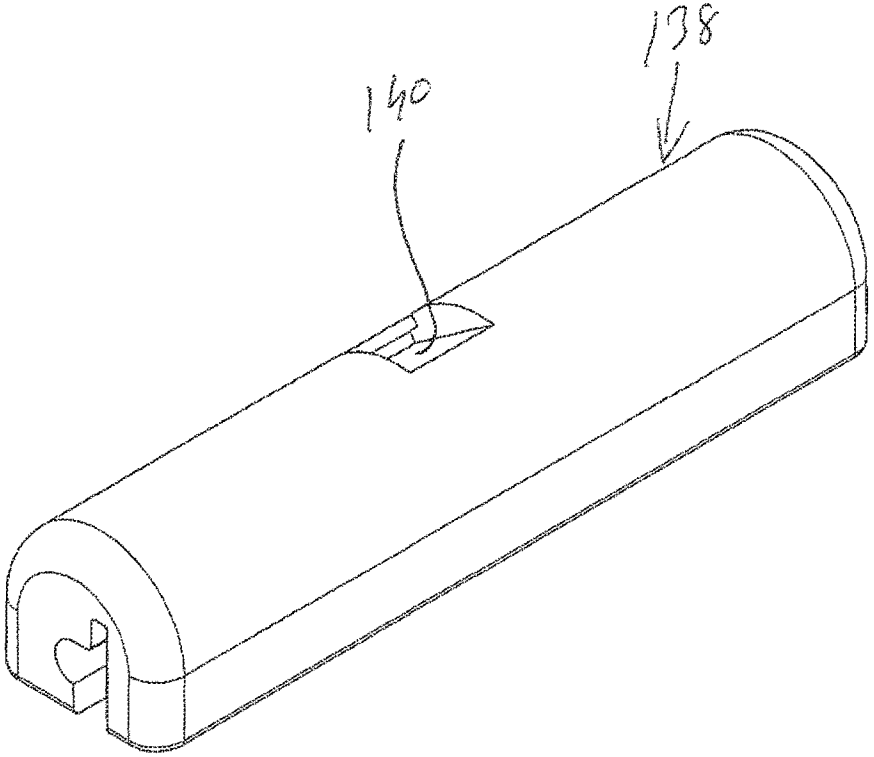
FIG. 9 is a rear perspective view of the cushion of FIG. 8 illustrating the accessory holder.
Figure 10:
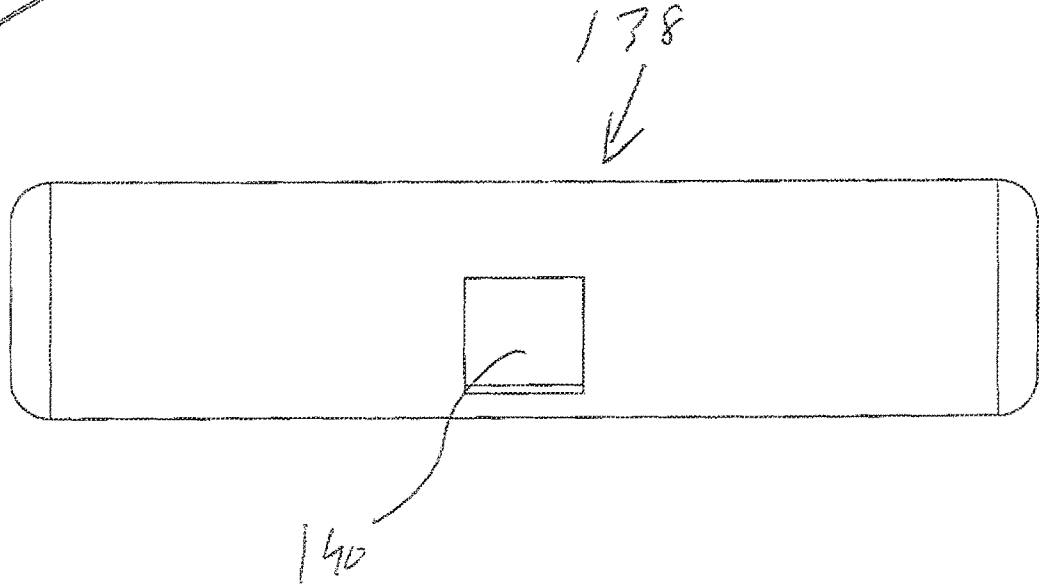
FIG. 10 is a top view of the cushion of FIG. 8.
Figure 11:
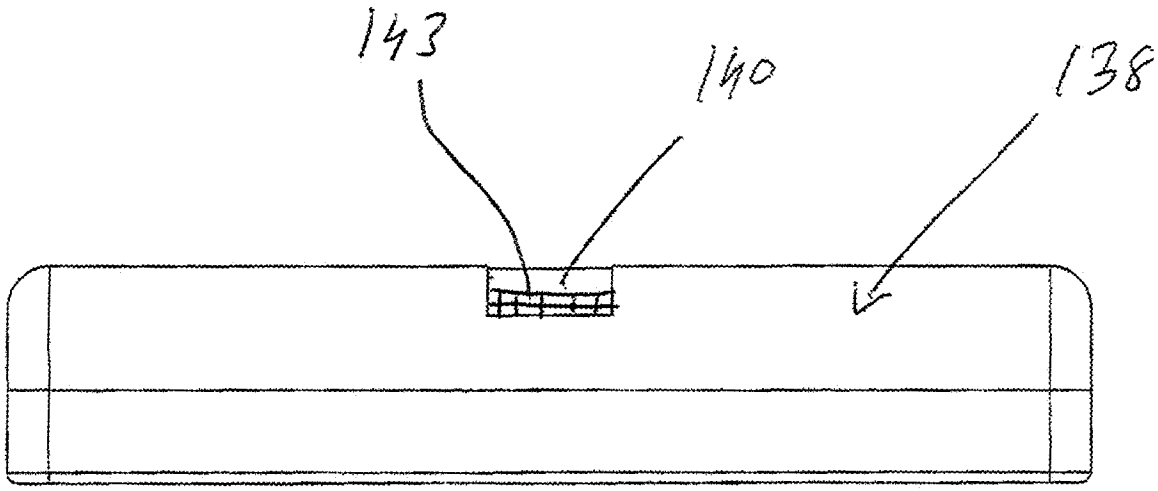
FIG. 11 is a front elevational view of the cushion of FIG. 8.
Figure 12:
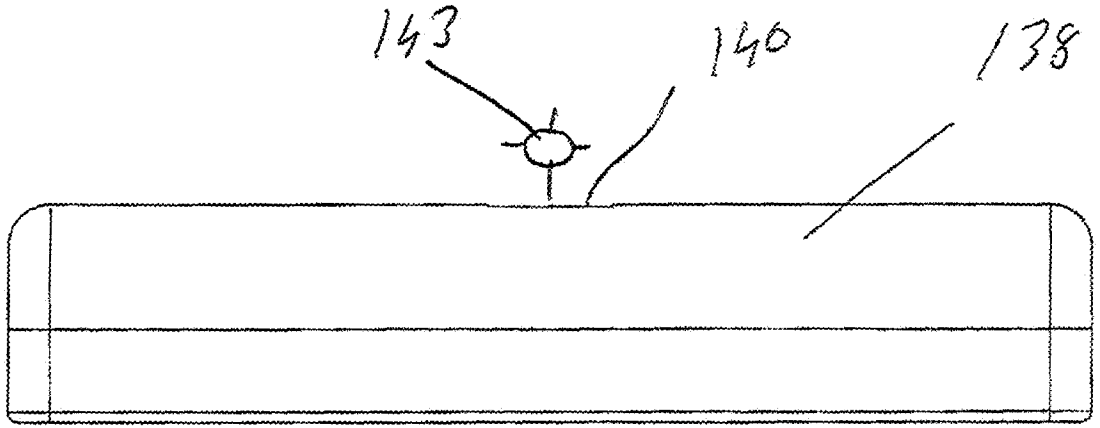
FIG. 12 is a rear elevational of the cushion of FIG. 8.
Figures 13, 14:
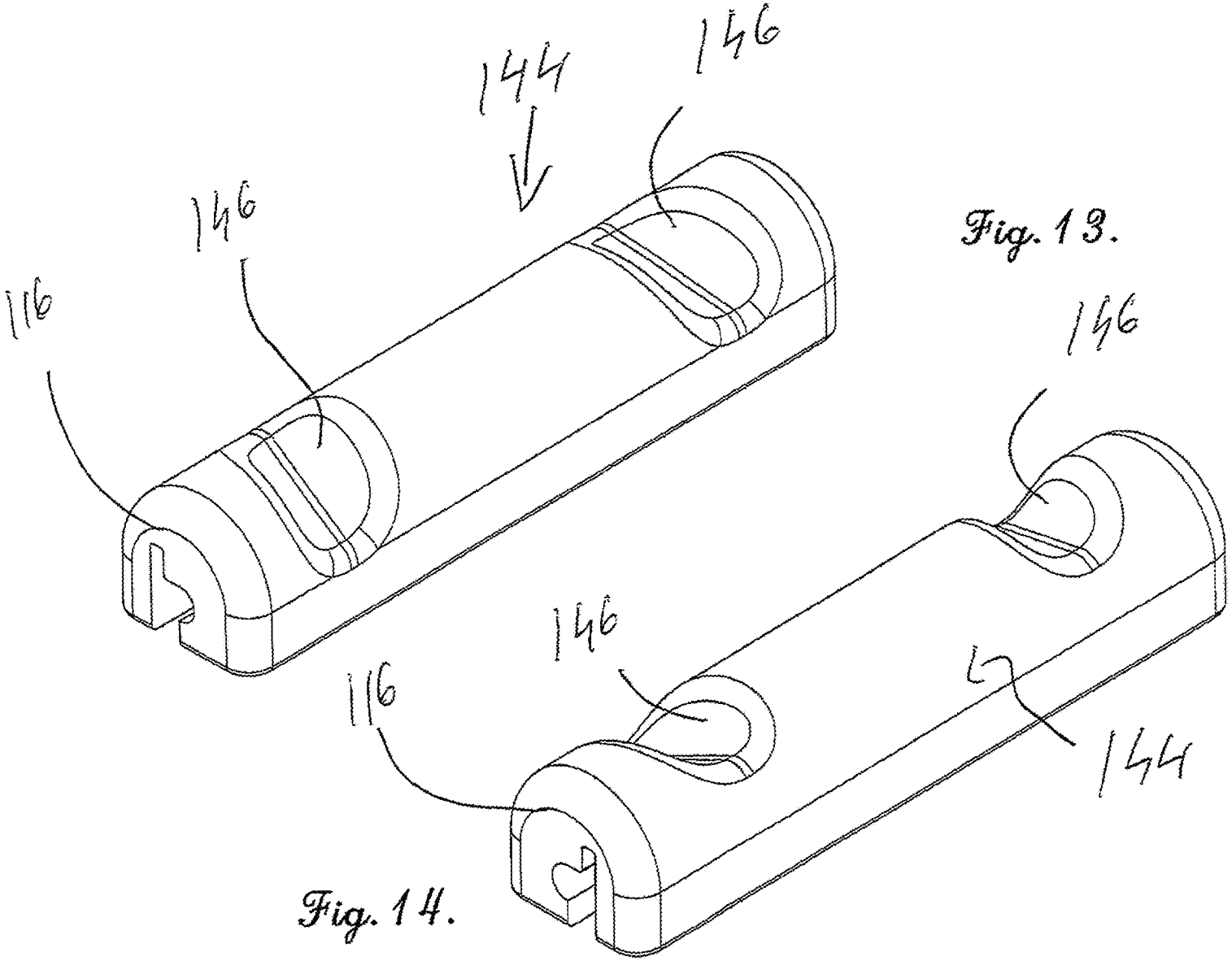
FIG. 13 is a front perspective of another exemplary cushion of the present disclosure and having at least one indentation.
FIG. 14 is rear perspective view of the cushion of FIG. 13.
Figure 15:
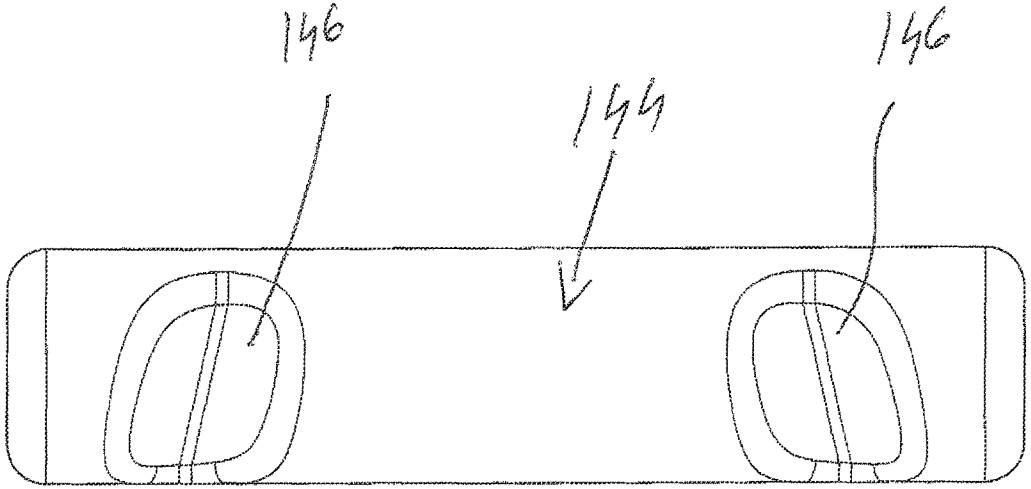
FIG. 15 is a top view of the cushion of FIG. 13.
Figure 16:
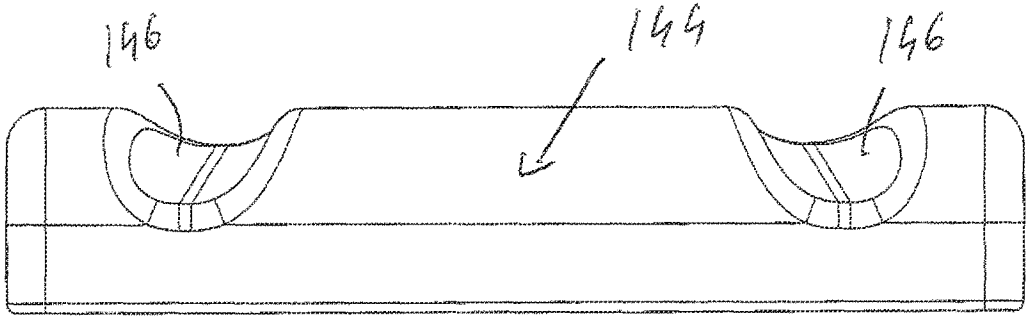
FIG. 16 is a front elevational view of the cushion of FIG. 13.
Figure 17:
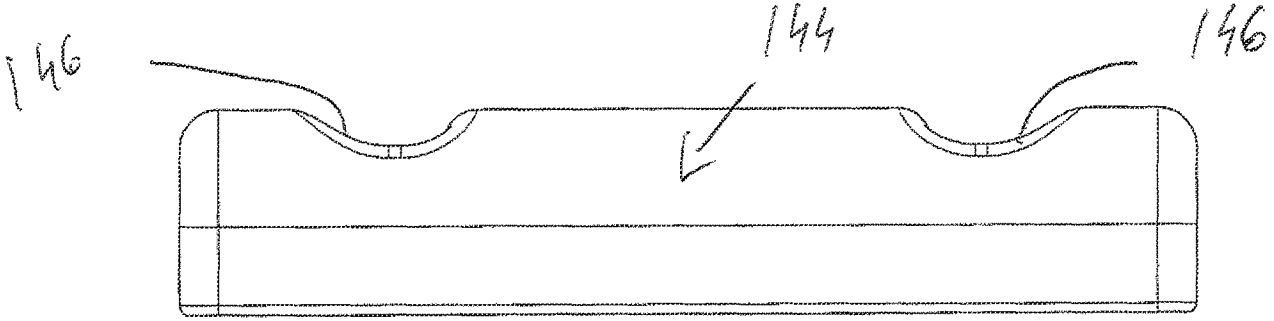
FIG. 17 is is a rear elevational of the cushion of FIG. 13.
Figure 18:
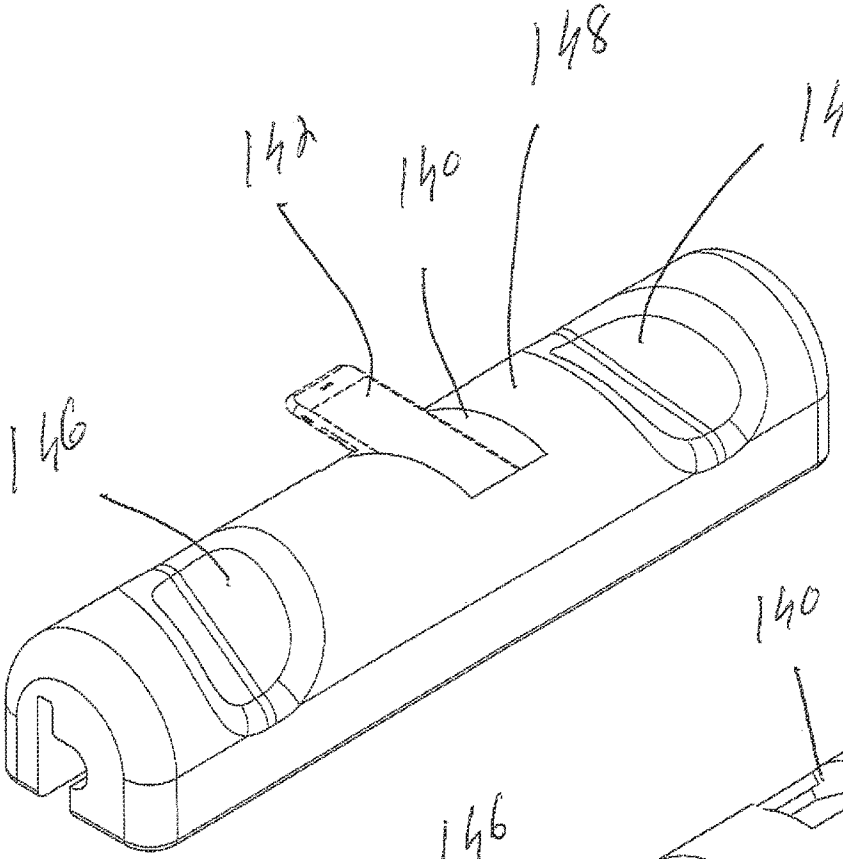
FIG. 18 is a front perspective view of another exemplary cushion of the present disclosure and having an accessory holder configured to hold an accessory and having an indentation.
Figure 19:
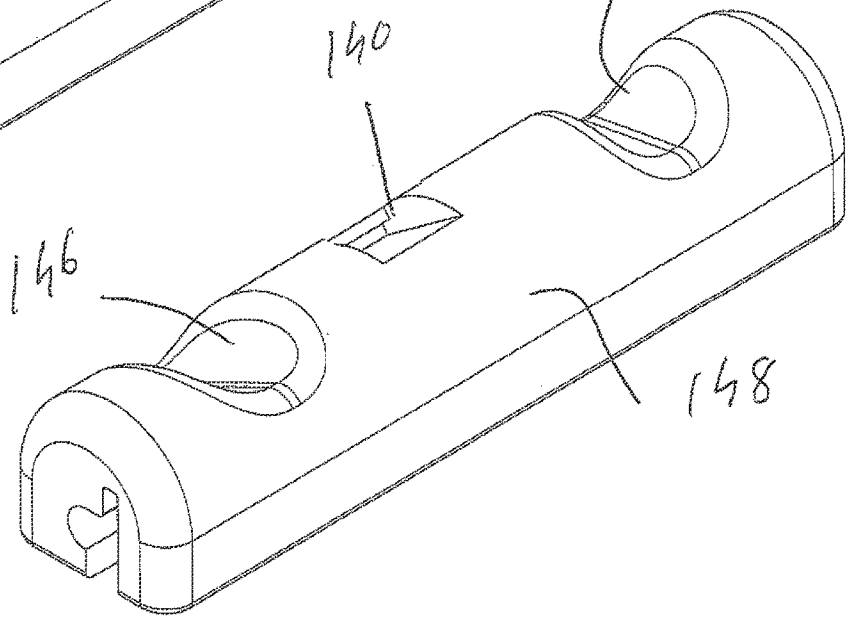
FIG. 19 is a rear perspective view of the cushion of FIG. 18 illustrating the accessory holder and the indentation.
Figures 20, 21, 22:
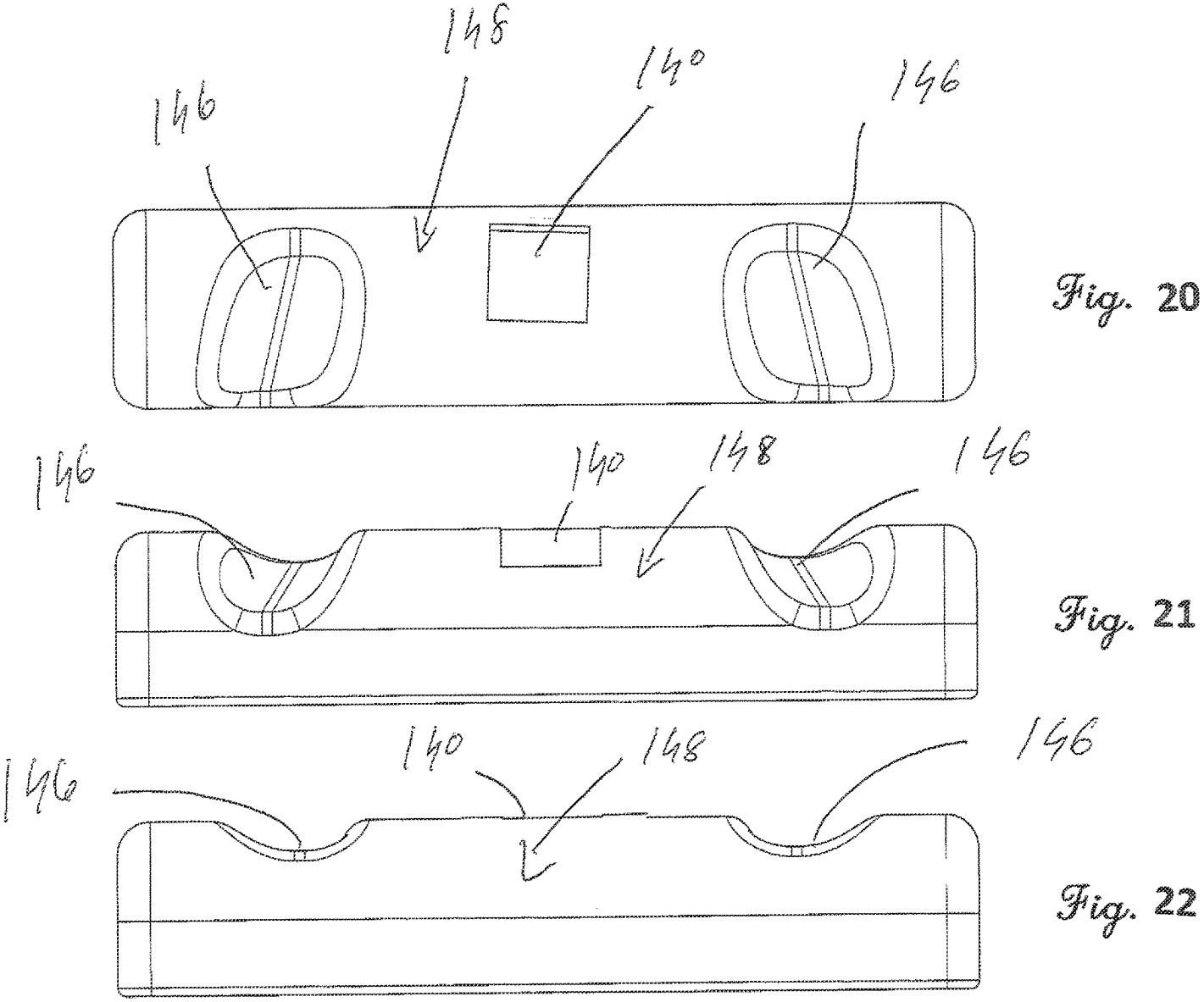
FIG. 20 is top view of the cushion of FIG. 18.
FIG. 21 is a front elevational view of the cushion of FIG. 18.
FIG. 22 is a rear elevational view of the cushion of FIG. 18.

FIG. 3 is an end elevational view of the cushion 100 of FIG. 2. FIG. 4 is a top view of the cushion 100 of FIG. 2. FIG. 5 is a side elevational view of the cushion 100 of FIG. 2. The cushion 100 can have a variety of lengths, heights, and thicknesses. In an embodiment, the cushion 100 has: a length from about six inches to about two feet and six inches; a height from about one inch to about ten inches; and, a width from about one inch to about 10 inches. The length, height, and thickness facilitates providing the surface area 124 for the user to comfortably rest or lean the user's hands, arms and/or elbows on the cushion 100 while distributing the user's weight applied to the cushion 100. Distributing the user's weight facilitates protecting the fence tips 108 from deformation or damage from the user's weight.

FIGS. 7-12 illustrate another exemplary embodiment of a cushion 138. The cushion 138 is similar to cushion 138 but further includes at least one assessor holder 140. In the exemplary embodiment, the at least one accessory holder 140 is integrally formed and coupled to the body 116 and can extend into the surface 124. As such, the accessory holder 140 is integrally formed into the cushion 138. The accessory holder 140 can be formed at any location on the cushion 138. The accessory holder 140 is sized, shaped and configured to hold, position and/or stabilize an accessory 142 such as, but not limited to, a mobile phone. The accessory holder 140 can include a slot extending into the surface of the body 116. Alternatively, the accessory holder 140 can include at least one of a cup holder, a pocket, and device holder. The accessory holder 140 can also include a power source 143 such, for example only, a solar panel and/or a small wind turbine.

Moreover, in another embodiment, the accessory holder 140 can be removably coupled to the cushion 138. More particularly, the removable accessory holder 140 can removably couple to the body 116 by attaching, clipping, pressure fitting, and/or adhesion (for example by an adhesive) to any location on the cushion 138. The removable accessory holder 140 can be placed at any location on the cushion 138 to facilitate convenient placement of the accessory holder 140 and the user's body parts which are leaning or resting on the cushion 138.

FIGS. 13-17 illustrate another exemplary embodiment of a cushion 144. The cushion 144 is similar to cushion 100 but further includes at least one indentation 146. In the exemplary embodiment, the indentation 146 is integrally formed and coupled to the body 116 and can extend into the surface 124. As such, the at least one indentation 146 is integrally formed into the cushion 138. The indentation 146 can be formed at any location on the cushion 144. The at least one indentation 146 is sized, shaped and configured to hold, position and/or stabilize the user's body parts, such as, forearms while the user leans or rests on the cushion 144. In an embodiment, the at least one indentation 146 includes a pair of indentations 146.

Moreover, in another embodiment, the indentation 146 can be removably coupled to the cushion 144. More particularly, the indentation 146 can removably couple to the body 116 by attaching, clipping, pressure fitting, and/or adhesion (for example by an adhesive) to any location on the cushion 144. The removable indentation 146 can be placed at any location on the cushion 144 to facilitate convenient placement of the user's body parts which are leaning or resting on the cushion 144.

FIGS. 18-22 illustrate another exemplary embodiment of a cushion 148. The cushion 148 is similar to cushion 100 but further includes the at least one accessory holder 140 and the at least one indentation 146.

In an alternative embodiment, the cushion includes a removable bracket (not shown) that is configured to couple the cushion to the fence. For example, the bracket can include an arm that couple to the cushion at one arm end and couples to the fence portion such as the mesh portion or support post at another arm end.

During use, a user carries the cushion 100 toward the fence 102. The user can pressurably slide or position the cushion 100 over the top rail 106 and at least one fence tip 108 to removably couple the cushion 100 to the fence 102. In one exemplary method, the user moves, bends, or flexes the cushion 100 into the first position by moving the first side 120 and/or second side 122 away from each other. The user can align the first channel portion 132 relative to the top rail, align the second channel portion 134 relative with at least one fence tip 108 and align the third channel portion 136 relative the mesh 104. The user can then move, bend and/or flex the cushion into the second position by moving the first side 120 and/or second side 122 toward each other. In the second position, the first channel portion 132 is sized and shaped to receive, accommodate, fit, surround and/or partially surround the top rail 106. The second channel portion 134 is sized and shaped to receive, accommodate, fit, surround and/or partially surround at least one of the fence tips 108. The third channel portion 136 is sized and shaped to accommodate, receive, fit, surround and/or partially surround portion of the chain link mesh 104 and/or top rail 106.

With the cushion 100 removably coupled to the fence 102, the user can rest or lean body parts, such as, hands, forearms, and/or elbows on the cushion 100 to distribute the user's weight across or throughout the cushion 100 to reduce, minimize or eliminate damage of the user's weight being applied to fence part such as the top rail 106 and/or fence tips 108. Additionally, the cushion 100 provides comfort to the user. The user can also place body parts in the at least one indentation 146. Moreover, the user can place an accessory 142 into the accessory holder 140.

The user can then pull the cushion off the fence 100 to removably de-couple the cushion from the fence 102. In an exemplary embodiment, the user moves, bends, or flexes the cushion 100 into the first position by moving the first side 120 and/or second side 122 away from each other to separate the first channel portion 132, the second channel portion 134 and the third channel portion 136 from the top rail 106, the at least one fence tip 108 and the mesh 104 respectively.

A technical effect of the systems, devices, and methods described herein includes at least one of: a member having a first end, a second end, and a body extending therebetween along a longitudinal axis between the first end and the second end; and a fence portion coupled to the member, the fence portion comprising: a first portion end; a second portion end; and a channel extending between the first portion end and the second portion end, wherein the channel is configured to reciprocate between a first position and a second position such that in the second position the channel is configured to removably couple to the fence The exemplary embodiments described herein facilitate a user comfortably resting or leaning on a fence. More particularly, the exemplary embodiments are configured to maximize user comfort and minimize damage to the fence. Still further, the exemplary embodiments increase user efficiency and reduce manufacturing costs associated with a cushion.

Features of one or more embodiments described above may be used in various combinations with each other and/or may be used independently of one another. For instance, although a single disclosed embodiment may include a preferred combination of features, it is within the scope of certain aspects of the present disclosure for the embodiment to include only one (1) or less than all of the disclosed features, unless the specification expressly states otherwise or as might be understood by one of ordinary skill in the art. Therefore, embodiments of the present disclosure are not necessarily limited to the combination(s) of features described above.

The preferred forms of the disclosure described above are to be used as illustration only and should not be utilized in a limiting sense in interpreting the scope of the present disclosure. Obvious modifications to the exemplary embodiments, as hereinabove set forth, could be readily made by those skilled in the art without departing from the spirit of the present disclosure.

Although the above description presents features of preferred embodiments of the present disclosure, other preferred embodiments may also be created in keeping with the principles of the disclosure. Furthermore, as noted previously, these other preferred embodiments may in some instances be realized through a combination of features compatible for use together despite having been presented independently as part of separate embodiments in the above description.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A cushion for a fence, the cushion comprising;

a member having a first end, a second end, and a body extending therebetween along a longitudinal axis between the first end and the second end, the body having a first side, a second side, and a surface extending therebetween; and a fence portion coupled to the member, the fence portion comprising:

a first portion end;

a second portion end; and a channel extending between the first portion end and the second portion end, wherein the channel is configured to reciprocate between a first position and a second position such that in the second position the channel is configured to removably couple to the fence, the channel comprising:

a first channel portion that extends into the fence portion and toward the first side of the body;

a second channel portion that extends from the first channel portion, into the fence portion and toward the surface of the body; and a third channel portion that extends from the first channel portion and opposite and away from the second channel portion.

2. The cushion of claim 1 wherein the first side and the second side are parallel to each other.

3. The cushion of claim 2 wherein the surface is configured to curvilinearly extend between the first side and the second side.

4. The cushion of claim 1 wherein the first channel portion comprises a curvilinearly shape.

5. The cushion of claim 1 wherein the second channel portion comprises a rectangular shape.

6. The cushion of claim 1 wherein the first channel portion comprises a shape different than the second channel portion.

7. The cushion of claim 1 wherein the fence portion is integrally coupled to the body.

8. The cushion of claim 1 wherein the fence portion is removably coupled to the body.

9. The cushion of claim 1 wherein the body comprises at least one indentation extending into the surface and toward the longitudinal axis.

10. The cushion of claim 1 further comprising an accessory holder coupled to the body.

11. The cushion of claim 10 wherein the accessory holder is removably coupled to the body.

12. The cushion of claim 10 wherein the accessory holder is integrally coupled to the body.

13. The cushion of claim 10 wherein the accessory holder includes at least one of a cup holder, a pocket, a device holder, and a mobile phone holder.

14. The cushion of claim 1 further comprising an accessory slot extending within the body.

15. The cushion of claim 1 further comprising a power source coupled to at least one of the body and the fence portion.

16. The cushion of claim 15 wherein the power source comprises at least one of a solar panel and a wind turbine.

17. A cushion for a fence, the cushion comprising:

a member having a first end, a second end, and a body extending therebetween along a longitudinal axis between the first end and the second end; and a fence portion removably coupled to the body, the fence portion comprising:

a first portion end;

a second portion end; and a channel extending between the first portion end and the second portion end, wherein the channel is configured to reciprocate between a first position and a second position such that in the second position the channel is configured to removably couple to the fence.

* * * * *